United States Patent [19]

Ragan

[11] 3,964,011

[45] June 15, 1976

[54] SINGLE TURN VARIABLE RESISTANCE DEVICE HAVING A SPLIT SHAFT ROTOR

[75] Inventor: Randall C. Ragan, Rancho Santa Fe, Calif.

[73] Assignee: North American Philips Corporation, New York, N.Y.

[22] Filed: Mar. 18, 1974

[21] Appl. No.: 452,130

[52] U.S. Cl. ..... 338/166; 338/157; 338/174; 338/202

[51] Int. Cl.[2] ..... H01C 10/32

[58] Field of Search ..... 338/166, 163, 167, 175, 338/174, 162, 170, 202, 157, 158, 334; 403/290

[56] References Cited

UNITED STATES PATENTS

| | | | |
|---|---|---|---|
| 2,143,401 | 1/1939 | Arvin | 338/162 |
| 2,593,332 | 4/1952 | Muchea | 338/166 X |
| 2,757,264 | 7/1956 | Zarrillo | 338/174 X |
| 2,866,054 | 12/1958 | Purdy | 338/174 |
| 2,925,575 | 2/1960 | Barden | 338/166 |
| 3,319,209 | 5/1967 | Reyenga | 338/162 |
| 3,343,116 | 9/1967 | Budd et al. | 338/174 |
| 3,421,133 | 1/1969 | Van Benthuysen | 338/174 |
| 3,497,847 | 2/1970 | Schapiru | 338/162 X |
| 3,531,753 | 9/1970 | Geese | 338/174 X |
| 3,531,754 | 9/1970 | Geese | 338/202 X |
| 3,710,674 | 1/1973 | Tabor | 403/290 X |
| 3,772,630 | 11/1973 | Falco | 338/174 |

*Primary Examiner*—Bruce A. Reynolds
*Attorney, Agent, or Firm*—Frank R. Trifari; Daniel R. McGlynn

[57] ABSTRACT

A single turn potentiometer is constructed as either an open frame or a housed unit. Both units incorporate a helical coil spring wiper mounted within a rotor. In the open-frame unit, the rotor includes a shaft which extends through a corresponding hole on a ceramic substrate. The ceramic substrate cooperates with the rotor and includes a deposited cermet resistance element and a circular collector ring. A stop arrangement is built into the rotor in the open-frame unit. The closed-frame unit includes a housing having a molded-in stop for cooperation with a similar stop on the rotor. In the open-frame unit, the shaft which protrudes through the hole in the substrate is of split configuration and is spread by an insert to hold the rotor to the substrate in riveting fashion. The closed-frame unit employs a peened-over portion of the housing which is used to constrain the assembly. Means and method for affixing the conductor leads to the substrate are disclosed.

2 Claims, 23 Drawing Figures

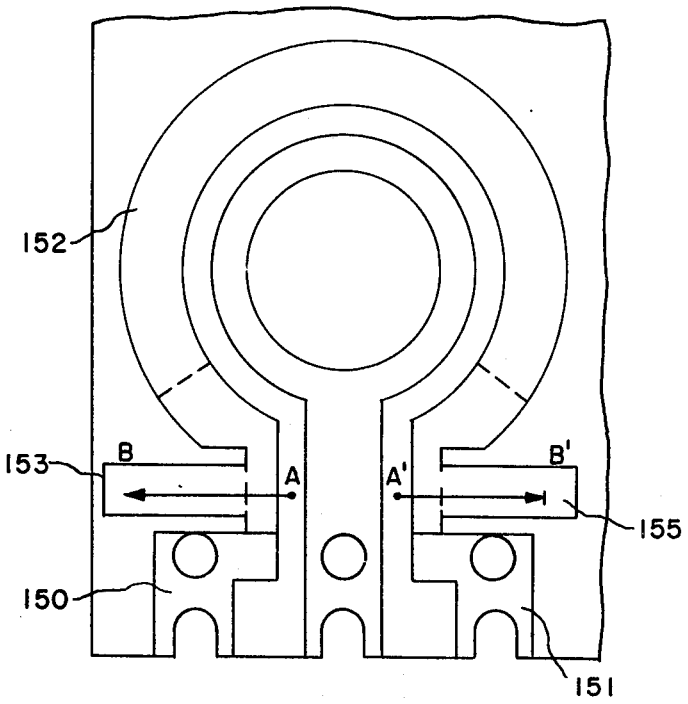
Fig. 16a
Fig. 16b
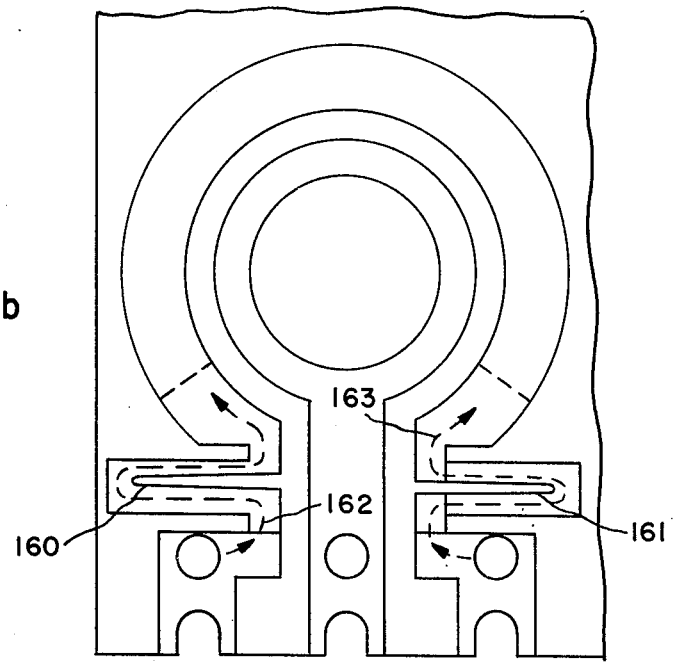

SINGLE TURN VARIABLE RESISTANCE DEVICE HAVING A SPLIT SHAFT ROTOR

FIELD OF THE INVENTION

This application relates to variable resistor devices such as potentiometers and, more particularly, small, compact and simply constructed single-turn potentiometers.

BACKGROUND OF THE INVENTION

It has long been felt that there exists a need for an extremely simple, economical and reliable single-turn potentiometer. One recent development in this search has resulted in the use of a shortened helical spring to form the wiper portion of a rotor assembly. The helical spring replaces earlier wipers of the plural finger type. This recent design included the use of a recess in the rotor for insertion of an element formed of resilient material such as silicone rubber as a backing for the helical spring. The resilient element essentially embraces and presses against the rear portion of the coiled spring wiper which is held in the recess of the rotor. Thus when the rotor rotates, the resilient element helps the wiper slide smoothly along the surface of the resistance element. The individual coil sections of the spring effect multiple electrical contact with the resistance element. In this construction, a rather short coil spring was employed to enhance the smooth sliding of the wiper so as to provide optimum mechanical and electrical characteristics of the potentiometer.

In spite of the improvement in using a coil spring wiper, problems still exist in providing reduced contact resistance variation (CRV) and improved torque control. Problems also exist in providing reliable electrical connections to the substrate element.

The present invention has as an object the employment of a coil-springed wiper in a miniature potentiometer together with other advantages and simplicities of construction.

It is the purpose of the present invention, therefore, to provide a single-turn potentiometer employing a miniaturized coil spring and resilient rubber backing to effect a smooth wiping of a cermet resistance element.

It is another object of the present invention to provide an open-frame unit having a minimum number of parts to enable rapid and economical assembly of the unit.

It is an additional object of the present invention to affix a rotor to a potentiometer including a substrate element wherein the rotor is held by a riveting arrangement.

It is still another object of the present invention to provide a method of affixing a rotor to a substrate in a potentiometer which simultaneously improves the torque and contact resistance variations of the potentiometer.

It is a still further object of the present invention to provide an open frame potentiometer unit wherein the mechanical stop on the unit is obtained by the cooperation of a projection from the rotor together with a portion of the conductor which makes electrical contact with the potentiometer.

A still further object of the present invention is the provision of a novel approach and method for the connection of conductive elements to a substrate.

Still another object of the present invention is the provision of a dust-free closed-frame unit having a built-in stop mechanism and a simplicity of assembly and construction.

It is still an additional object to provide a potentiometer having optional resistance material on its substrate which may be inserted in series with the terminals of the potentiometer by laser removal of resistance material.

Other objects of the present invention will become apparent by reference to the following description and drawings while the scope of the invention will be pointed out in the appended claims.

BRIEF SUMMARY OF THE INVENTION

In accordance with the present invention a variable resistance device comprises a substrate having an opening therein, the substrate including a central collector ring and an arcuate resistance element. The device also includes terminal means on the substrate for connection to at least one end of the wiper assembly and the central collector ring. A rotor is also included having a split shaft extending therefrom, said shaft extending through the opening and journalled to rotate in the opening of the substrate, the rotor including a multiple contact wiper for making electrical contact between the collector ring and the arcuate resistance element. Means are also included for inserting a separating element through the opening for enlarging the shaft end to fasten the rotor onto the substrate.

In another aspect of the present invention, a method for connecting a conductor lead to a ceramic substrate, the substrate having a predetermined hole for the insertion of the lead, and a notch at the edge for locking, comprises the steps of creating a small "s" shaped bend in a conductor lead so that the conductor has a first and longer portion below the bend, and a shorter portion above the bend, the longer and shorter portion being approximately parallel to each other. Also included is the step of creating an approximately 90° bend in the shorter portion so that the conductor has a still shorter second portion above the *s* bend which remains parallel to the first portion and a third portion at the end of the conductor which is approximately 90° with respect to the first and second portions. Steps are included for inserting the third portion end of the conductor through a hole in the substrate which has a distance from the end of the substrate no longer than the length of the second conductor portion so that the inner side of the second conductor portion is tangent to the substrate surface and bending the third portion of the conductor which protrudes from the substrate another 90° toward the first portion of the conductor so as to substantially wrap the conductor around the portion of the substrate between the hole and the notch at the end of the substrate.

BRIEF DESCRIPTION OF THE DRAWINGS

In the drawings,

FIG. 9 illustrates the construction of the conductor, which figure is broken into separate sub-figures.

FIG. 9A1 through 9A4 shows the necessary prebending of the conductor prior to the assembly.

FIG. 16A illustrates the form of the resistance element together with terminal pads for use in adding series resistance by laser scribing; FIG. 16B shows the element after scribing.

DESCRIPTION OF THE PRINCIPAL EMBODIMENTS

Figure 1:
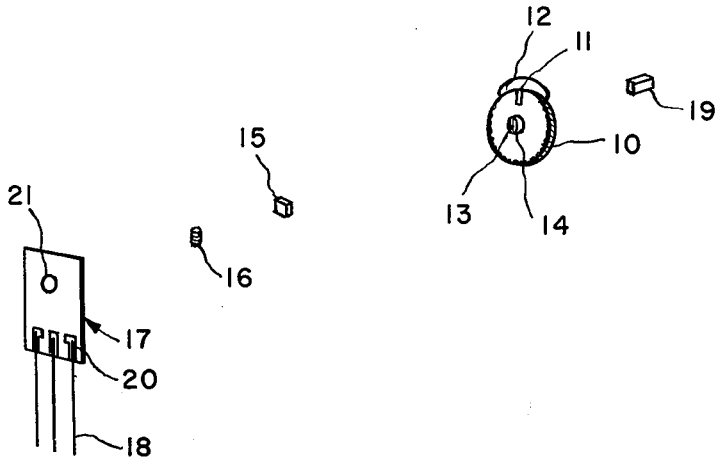
FIG. 1 represents an isometric illustration showing the way the parts of the open-frame unit are assembled.

Referring initially to FIG. 1, shown there is the assembly of a single turn variable resistance device including a ceramic substrate 17 and a rotor 10. The rotor 10 is preferably a molded, one-piece thermoplastic unit which includes a split shaft 13, a slot or recess 11, and a projection 12. The rotor 10 is basically of circular cross section and has knurled or reeded side portions. Recess 11 is constructed of predetermined depth sufficient to receive rectangular resilient element 15 which forms the resilient backing for the helical coil spring wiper contact 16. The depth of recess 11 is chosen so that the resilient element 15 and wiper contact 16 protrudes sufficiently above the plane of the recess-opening such that the element 15 will be in compression after assembly.

FIG. 1 illustrates as well the rear view of the substrate subassembly 17. The substrate subassembly includes an opening or hole 21 sufficiently large so that shaft 13 of the rotor may be inserted therethrough. The shaft extends through the opening 21 and is journalled to rotate in the opening. Also shown are the rear terminal pads 20 on the substrate 17. The terminal pads are metallized portions used to establish electrical contact with the conductors shown in FIG. 1 as 18. The conductors are inserted in respective holes placed in the terminal pads through the substrate element in a manner to be described below.

Riveting element 19 also shown in FIG. 1 acts as means for separating the ends of the split shaft extending through the opening for enlarging the shaft end to fasten the rotor onto the substrate. Element 19 is a small block which is inserted within irregular shaped slot 14 in the center of shaft 13 of the rotor. After the rotor is assembled with the helical wiper and resilient support in recess 11 and the shaft end is placed through the hole in substrate assembly 17, riveting element 19 is inserted in the slot from the rear portion of the rotor (not seen in FIG. 1) to spread the portion of the rotor shaft in riveting fashion so as to create a firm mechanical lock which maintains the open-frame potentiometer in its final assembled state. Even though large stresses are placed on the rotor shaft during movement and rotation of the rotor, the riveting action of the block 19 within slot 13 will prevent disengagement of the rotor. This technique of riveting provides substantial advantages in that it simultaneously brings the rotor into firm contact with the substrate to improve contact resistance variation, prevents the separation of rotor and substrate and, by expanding the shaft in the hole provides necessary torque control of the rotor.

Figure 2:
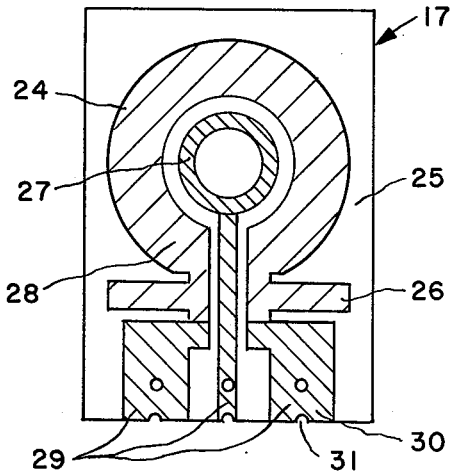
FIG. 2 is a plan view of a fired cermet substrate, showing the resistance element, terminal pads and collector element.

FIG. 2 illustrates the fixed substrate in accordance with the present invention. The substrate 17 comprises a ceramic base 25 upon which the collector ring 27, resistance element 26 and the terminal pads 29 are imprinted by standard cermet and metallizing techniques. Collector ring 27 is a thin, highly conductive ring composed of silver, silver palladium or gold platinum. The arcuate resistance element 26 has a loop portion surrounding the collector ring and two protruding portions for contacting the terminal pads 29. The substrate includes terminal means shown as the terminal pads 29 for connecting to at least one end of the resistance element 26 and the collector ring (or wiper arm of the potentiometer) is connected by a fired element to a central terminal pad. It is possible to include additional fixed resistors fired on the substrate itself which would be in series with either the wiper arm or the ends of the potentiometer. Each of the terminal pads also includes a hole through the terminal pad and through the ceramic substrate 25 and a semi-hole 31 for receiving a portion of the conductive lead. The spacing of the semi-hole in each conductor pad is determined by the pre-bent distances of the conductors as will be discussed further below. Further description of the substrate with regard to laser removal of material will also be discussed below.

Figure 3:
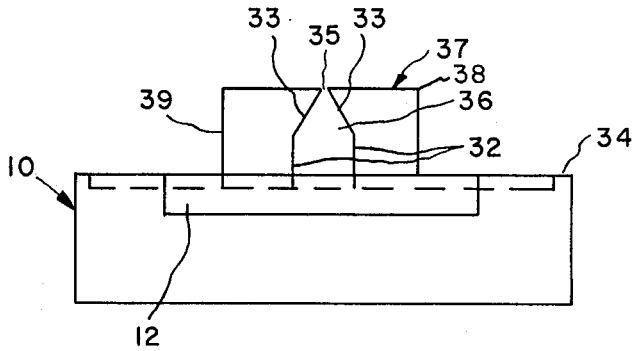
FIG. 3 is a side view of the rotor of the open frame unit.

FIG. 3 illustrates a side view of rotor 10 to show the construction of the shaft of the rotor. In this view, shaft 37 is actually composed of two portions 38 and 39. Between the two portions is a cavity 36. The cavity is bounded by side-walls 32 which are essentially parallel to each other and vertical sloping walls 33 which slant toward each other such that there is a very narrow opening 35 at the top of the shaft. FIG. 3 also illustrates the protrusion 12 which forms part of the stop mechanism. In assembling the open frame potentiometer, the riveting element 19 is inserted into the rotor in the direction of the arrow in FIG. 3.

Figure 4:
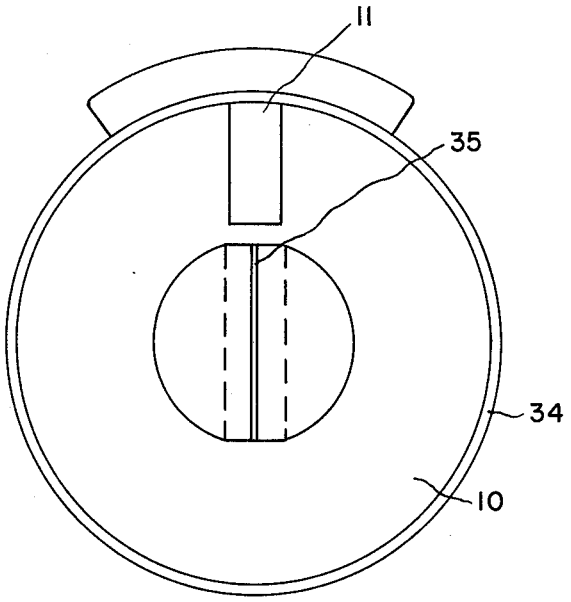
FIG. 4 is a frontal view of the rotor of the open-frame unit shown in FIG. 3.

FIG. 4 further shows the rotor in plan view including the narrow top opening 35 and the recess 11 for the receipt of the resilient backing element 15 and helical coil spring wiper 16. The rotor preferably also includes a narrow rim.

Figure 5:
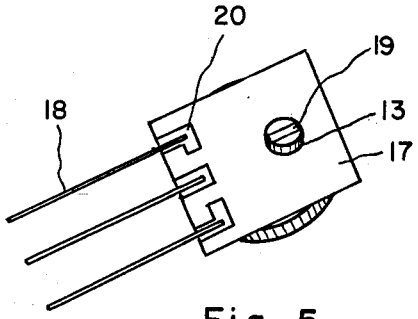
FIG. 5 is an isometric representation of the assembled open-frame potentiometer showing the protrusion of the rotor shaft as it would appear if the assembly of FIG. 1 were completed.

In final assembly, the open-frame unit is shown in FIG. 5. It will be noted that like elements retain like numbers in the various views. Shown there is ceramic substrate 17 through which shaft 13 protrudes. Riveting element 19 has been inserted between the two portions of the shaft, separating them and causing the shaft to have a larger diameter at its end than at its base. The effect of this construction is to create a firm but positive hold between rotor and substrate. The sloping portion of the two parts of the rotor shaft retains riveting element 19 in position. Other embodiments of riveting the rotor to the substrate will be discussed with respect to FIGS. 13, 14 and 15.

Figure 6:
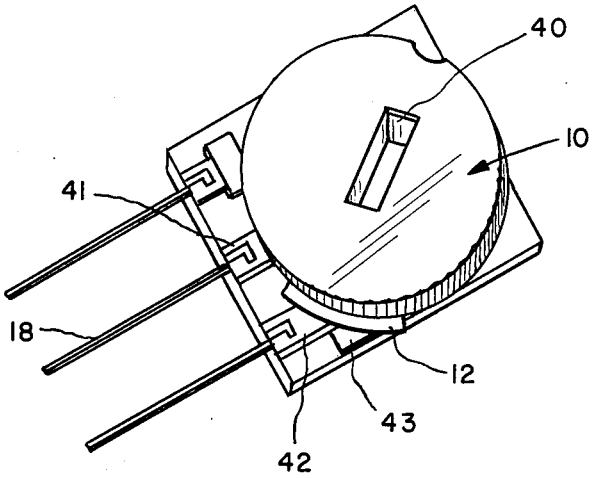
FIG. 6 is the under view of the isometric shown in FIG. 5 also in isometric view.

In FIG. 6, the stop mechanism of the open-frame unit is illustrated. There the protrusion 12 of the rotor 10 acts to interfere with a bent-over portion of conductor 18. The bent-over portion 41 will interfere with either side of protrusion 12 so that the potentiometer must have less than 360 degrees of rotor rotation. By selectively adjusting the rotational arc of the rotor projection 12, the limits of travel of the rotor can be predetermined. FIG. 6 also illustrates the preferred inclusion of a screw-driver slot 40 which may be used to rotate the rotor. Slot 40 also represents the point of entry of riveting element 19 in assembly of the unit. By making the rotor diameter larger than the width of the substrate, the rotor can also be turned by hand with the use of the knurled rim of the rotor.

Figure 7:
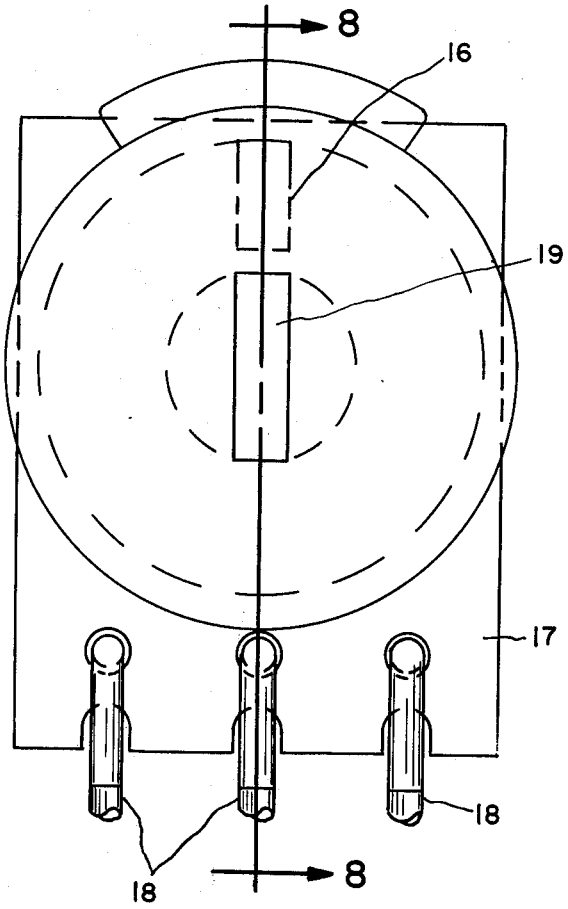
FIG. 7 illustrates a top assembly view showing the inter-relationship of the rotor and substrate.
Figure 8:
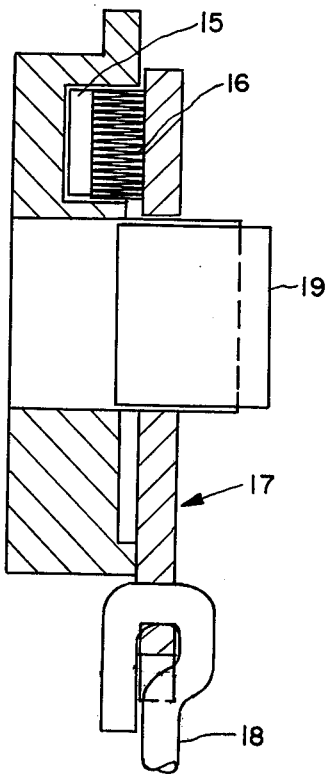
FIG. 8 is a side sectional view taken along lines 8—8 in FIG. 7 particularly illustrating the helical coil construction and assembly.

FIGS. 7 and 8 illustrate the operation of the spring wiper in making electrical contact with the resistance element and collector ring. In FIG. 7, the plan view of the assembly shows that the coil spring wiper contacts the collector ring 27 and the resistance element 26. Thus, as the rotor is turned, electrical continuity is established between the center terminal pad, the collector ring, the helical wiper 16 and the portion of the resistance surface in contact with the helical wiper. Each extreme end of the resistance element is in contact with the outer terminal pads of the potentiometer by the metallized sections of the pads.

In FIG. 8, the helical wiper 16 is shown pressing against the substrate portions including the collector ring, the resistance element and the un-inked area between the collector ring and resistance element. The helical coil 16 is being pressed against the substrate board 17 by virtue of the resilience of element 15 which is in compression. This enables a firm electrical contact to be made at relatively constant mechanical pressure as the rotor slides the helical wiper.

An extremely important aspect of the present invention is illustrated in the FIG. 9 drawings. There, the preliminary bending of the conductor leads is shown which enables a great flexibility in the attaching of leads to the substrate. The ultimate connection achieves an excellent mechanical and electrical contact. FIG. 9A illustrates that the conductor is arranged in the following manner:

A main axial portion 50 is bent so that a shallow "s" bend 51 is inserted between the main longer portion 50 below the bend and a small parallel portion 52 above the bend. An approximately 90° bend is made above portion 52 resulting in a final straight portion 54 which is perpendicular to both portions 52 and the original axial portion 50. It is possible to make the two bends simultaneously if desired. This pre-bending technique permits relatively easy and strong mechanical connection to be made with minimum stress on the substrate. Coining square corners assists in alignment to the substrate and stable mechanical attachment.

Figure 9B:
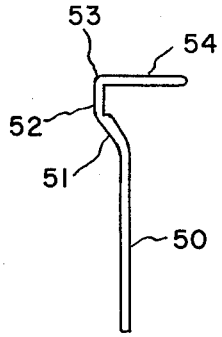
FIGS. 9B through 9E illustrate a side sectional view showing four of the possible employments of the prebent conductor constructed in the manner shown in FIG. 9A1 through 9A4.
Figure 9B:
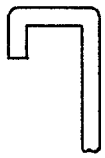
Figure 9B:
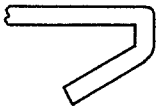
Figure 9B:
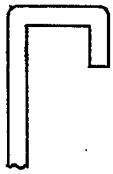

FIGS. 9B, C, and E show various ways this basic form of FIGS. 9A1 through 9A4 can be used to effect a variety of connections to a pre-drilled substrate depending on the direction the main axial portion is intended to take. In FIG. 9B, portion 52 parallels and is tangent to a small portion of the substrate with a portion of the lead 54 inserted into a pre-drilled hole in the substrate. The final connection is made by crimping end 54*a* to be at 90° with respect to original element 54 and parallel to 52. Thus, in FIG. 9B there is a single bending operation which may be made by ordinary tools. Portion 51 engages the edge notch in the substrate. Subsequently any desired metallizing may be used such as soldering to effect final electrical connection.

Figure 9C:
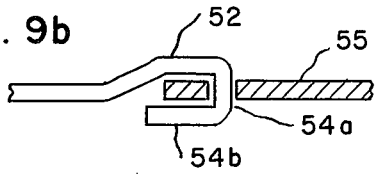
Figure 9D:
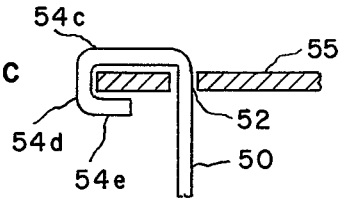
Figure 9E:
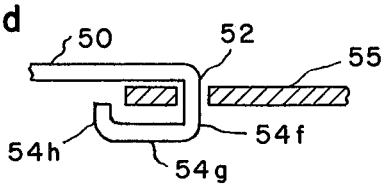

In FIG. 9C, end 54 is initially inserted into a pre-drilled hole in the substrate and the terminal is then rotated 90° so that portion 52 is in the hole with element 54 extending along the surface of the substrate. In this construction, two 90° bends are made up on the 54 portion of the lead resulting in portion 54*d*, which is at 90° with respect to 54 (now 54*c*), and portion 54*e*, which is 90° with respect to 54*d* but parallel to 54*c*. Portion 54*d* engages the notch. In FIG. 9D, the insertion of the terminal is approximately the same as that shown in 9B but an additional 90° bend results in portion 54*h* which engages the notch. In FIG. 9E, portion 54 is initially bent at its end at 90°. This new portion 54*j* is inserted in a pre-drilled hole in the substrate 55. Shown in FIG. 9E, an additional bend may be made to effect the final mechanical connection. This last portion becomes 54*k*. Portion 52 engages the notch.

It will be seen that in the applications of the basic pre-bent lead construction of FIG. 9A, numerous variations may be made which result in minimum stress to the substrate and a maximum mechanical connection. It might be analogized that the conductor is essentially wire-wrapped around a narrow portion of the substrate to form a positive locking arrangement. Following mechanical connection of the lead, metallization such as soldering is applied for making permanent electrical and mechanical connection.

Figure 10:
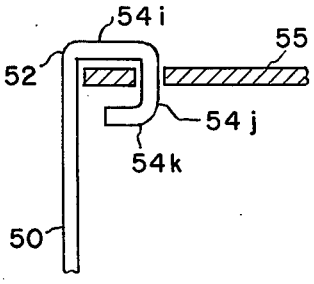
FIG. 10 illustrates in isometric view, the assembly inter-relationship of the parts of a closed-frame potentiometer constructed in accordance with the present invention.
Figure 10:
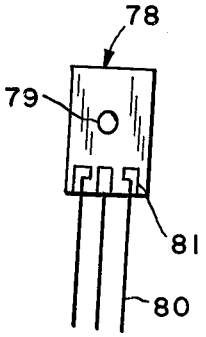
Figure 10:
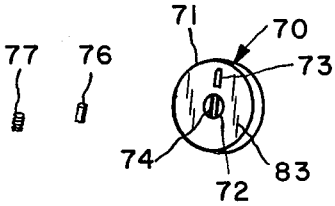
Figure 10:
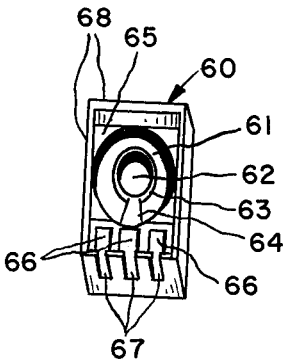

In FIG. 10, the parts of a closed unit potentiometer having many similar features of the open frame potentiometer are shown. The major portions of the assembly are the housing 60, the rotor 70, the resilient supporting element 76, helical coil wiper 77 and the ceramic substrate 78 shown in FIG. 10 with conductor leads attached. The combined assembly results in a substantially dust-free unit as contrasted with the open-frame constructed described earlier. Housing 60 includes a central opening through which the rear shaft of the rotor extends. Surrounding the opening is a collar or rim 63 and a bossed section 64. An annular cylinder surrounds the collar and bossed portion, the cylinder having walls which are substantially higher than the height of the collar or bossed sections. The top of the cylinder lies in a plane shown as 65 in FIG. 10.

The effect of this construction is to provide a recess for receipt of the rotor. The rotor has outer walls which are constrained by the walls of the cylinder of the housing. The collar and the walls of the cylinder in the housing provide a track for a bossed or projected portion of the rotor. The boss on the rotor interferes with the boss 64 in the housing to provide a mechanical stop for the rotor assembly, permitting rotation of less than 360°.

The housing also has side walls 68 which extend above the plane of surface 65. In the lower side wall, there are three slots 67 for receipt of the conductors which are affixed to the substrate. The housing also includes three substantially rectangular recesses 66 which extend from the plane 65 to the depth of the slot 67. These recesses are for the receipt of the terminal pads with the bent-over conductors which are affixed to the substrate.

Rotor 70 includes a rotor shaft 72 having a slot 74. A recess 73 is included as before the receipt of the resilient member 76 and the helical coil 77. When the rotor is inserted in the cylindrical recess of the housing, the surface of the rotor 83 is essentially in the same plane as plane 65 of the housing. Shaft 72 extends above that plane but below the height of the outer walls 68. The construction of the substrate sub-assembly 78 is identical with that for the open-frame unit. The substrate is preferably composed of ceramic material having an opening 79 for receipt of the rotor shaft and terminal pads 81, each of which have appropriate holes and semi-holes as previously described. Conductor leads 80 are affixed to the substrate 78 by the techniques and pre-bent leads described with respect to FIG. 9.

Figure 11:
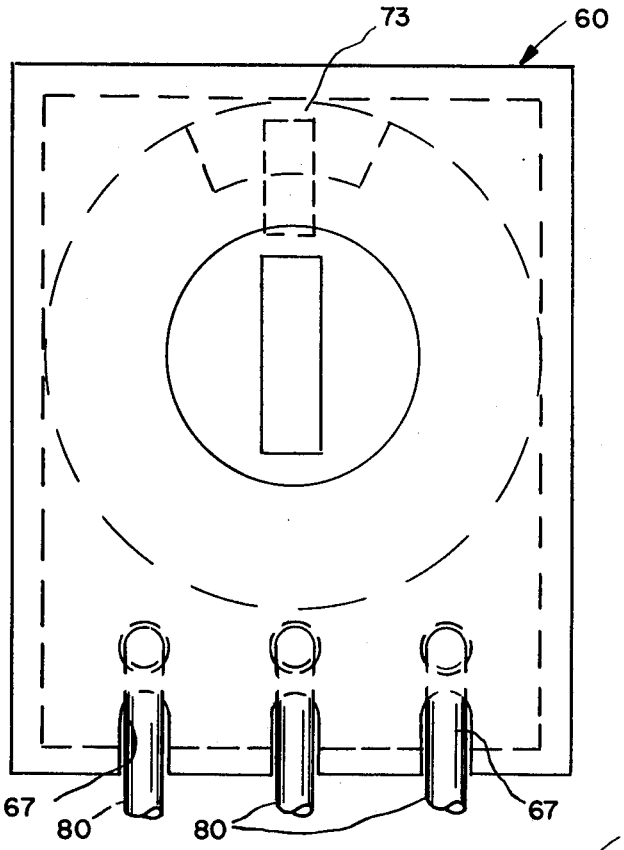
FIG. 11 is a top assembly view of the assembled closed-frame unit.
Figure 12:
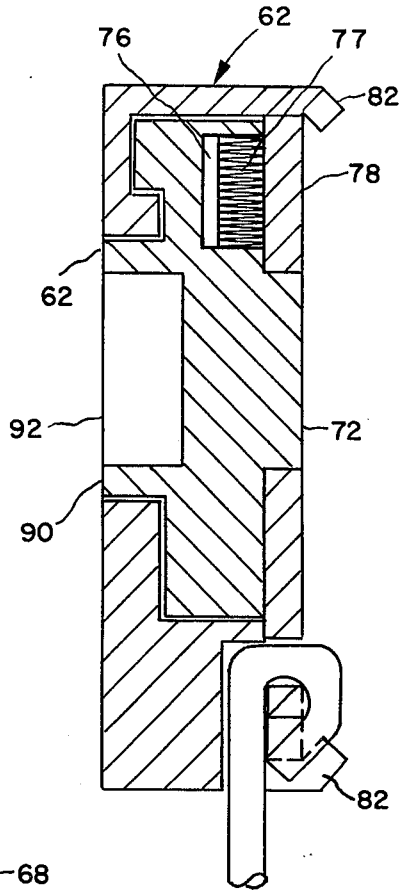
FIG. 12 is a side sectional view taken along lines 12—12 in FIG. 11 illustrating the closed-frame unit.

FIGS. 11 and 12 illustrate the assembled views of the closed frame unit.

In assembly, the rotor is dropped in the cylindrical cavity of the housing. The resilient supporting element 76 and helical coil 77 are inserted in recess 73, and the substrate 78 is superposed and dropped onto the rotor and housing. The unit is mechanically held together by peening over portions or the entire side wall or potting material (such as an appropriate epoxy resin) may be added to the surface of the open portion of the housing after assembly to provide a greater dust-free enclosure and also to strengthen the mechanical closing of the potentiometer (to be discussed below). Peened over portions 82 restrain the substrate and hold the unit together. The portions 82 are created by heat treating and bending these plastic portions. In that figure, it will be seen that the conductors 80 extend through the slot 67. Rotor shaft 72 is no longer required to extend through the substrate 78 as in the open unit since the unit is not held together by riveting. It is possible, however, to employ a similar technique in the closed-frame unit by extending the rotor shaft appropriately. In the closed frame unit, the surface of the rotor shaft 72 is flush with the outer side of the substrate 78. A slot in the rotor end may also be included to enable a screwdriver adjustment of the potentiometer to be made.

In FIG. 12 an additional shaft 90 extends through the opening 62 in the housing and is journalled for rotation in the opening. The diameter of this shaft is preferably larger than the shaft 72. A slot 92 for screwdriver adjustment may similarly be incorporated in this part of the shaft. Thus, the potentiometer may be so adjusted from either side.

Figure 12A:
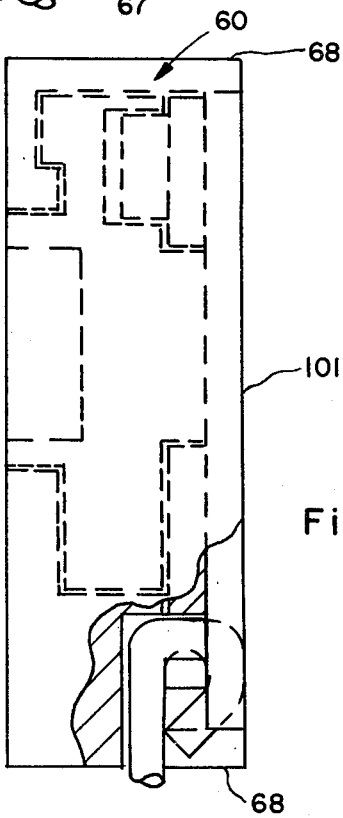
FIG. 12A is an alternate embodiment in side section of the closed-frame unit.

In FIG. 12A, an alternate view in partial side section of FIG. 11, illustrates a different closure of the closed frame unit. There, the side walls 68 are not peened over but instead a thickness of epoxy resin potting material 101 is disposed over the surface of the potentiometer. The potting material acts to encapsulate one side of the potentiometer and also to mechanically hold the assembly together.

Figure 13A:
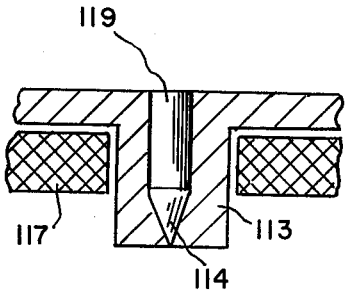
FIGS. 13A and 13B illustrate more detailed sectional views showing the fastening of the rotor in the open frame unit by the use of a rectangular rivet.
Figure 13B:
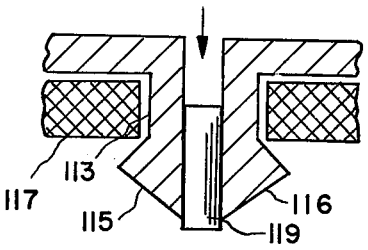
Figure 14A:
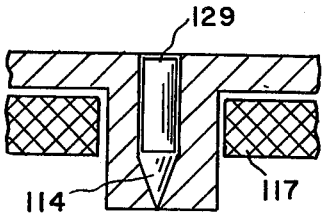
FIGS. 14A and 14B illustrate more detailed sectional views showing round rivet fastening of the open frame unit.

Variations of the riveting techniques, which is used primarily with respect to the open frame unit, are shown in FIGS. 13–15. FIG. 13A illustrates the initial insertion of the rectangular shaped riveting element 119 into slot 114 of the rotor shaft 113. Referring to FIG. 13B, the riveting element has been fully inserted into the slot 114 so that the end portions 115 and 116 of the shaft are separated. The rotor shaft 113 is now prevented from drawing away from substrate 117. It may be desired that a notch be inserted in the sides of rivet 119 to provide a positive lock with respect to the ends of the rotor shaft. This will also be helpful in preventing the riveting element 119 from being inserted too far during assembly.

Figure 14B:
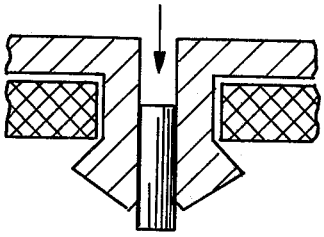
Figure 14C:
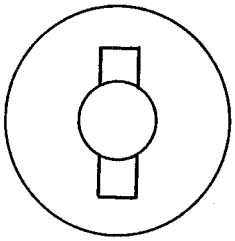
FIG. 14C shows a top view.

FIGS. 14 A, B, and C illustrate an alternate embodiment which employs a cylindrical rivet 129 inserted into slot 114 in the direction of the arrow in FIG. 14B. FIG. 14C illustrates a top view of the assembly. In this arrangement, notches may also be applied to the outer walls of rivet 129 again for providing a positive detent.

Figure 15A:
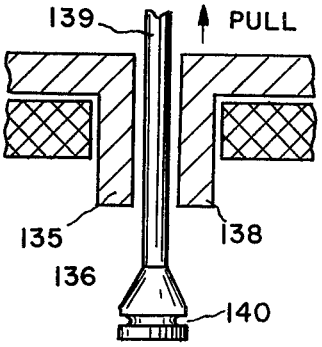
FIGS. 15A and 15B illustrate sectional views of a pull rivet fastening of the rotor.
Figure 15B:
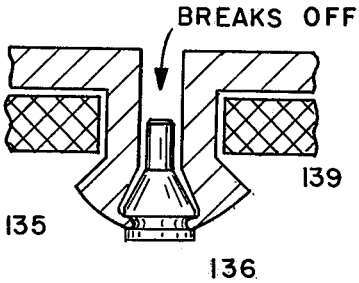

A different approach is shown to the riveting of the open frame unit in FIGS. 15A and B. In this embodiment, an elongated pull rivet 139 having a cross-section shown in FIG. 15A is inserted in the opposite end of tubular cavity 114. The rivet 139 is pulled in the direction of the arrow in FIG. 15A. FIG. 15B illustrates the securement of the rivet 139 in the rotor. The rotor is preferably arranged with a round hole through it for receipt of the rivet rather than the slot in the other embodiments. The ends of the rotor shaft 135 and 136 lodge in the ridge 140 of the rivet 139. The long end of the rivet breaks off leaving just the head secured in the rotor cavity.

A significant feature of the present invention is shown in FIGS. 16A and 16B. By the use of a cutting technique, preferably laser cutting or scribing, the substrate may be altered to add fixed resistors in series with the outer terminals of the potentiometer. Referring to FIG. 16A, shown there is arcuate resistance path 152 having projections 153 and 155 extending from the resistance path made of similar resistance material. At the end of the resistance path are metallized areas 150 and 151.

In order to create the desired resistances, a cut such as is made with a laser is begun at point A which continues in the direction of the arrow to point B of projection 153. The point where the cut terminates, (Point B) is determined by the value of resistance desired. A similar cut is made from point A′ to point B′ in projection 155. This addition of resistance material via projections 153 and 155 is called a "top hat" resistance configuration.

The result of the top hat scribing technique is shown in FIG. 16B. Narrow non-resistive portions 160 and 161 now appear in the projections of resistance material. Dashed lines 162 and 163 represent the path for current which is seen to be significantly longer than previously. The net effect is the addition of predetermined resistances in series with the outer potentiometer terminals.

While a number of different types of materials may be used for various elements of the combination of the present invention, certain specific compositions are preferred. The housing or case of the closed frame unit is preferably a molded thermoplastic as is the rotor construction of both the open and closed frame units. The only major constraint on the type of thermoplastic is that in the open frame construction the material must be flexible enough to permit the resilient bending of the two portions of the rotor when the riveting element is inserted.

The substrate material may be any ceramic type of composition with the required physical strength and electrical properties of ordinary substrates. It is possible however, to construct the potentiometer from a standard laminated board with etched copper conductors. A preferred type of ceramic composition is aluminum oxide. However, other types of ceramic such as steatite or beryllium oxide may also be employed. The resistance element is inked and fired as is well known using appropriate cermet compositions depending on the resistance desired.

The conductors are typically tin or solder-coated copper leads or may conceivably be aluminum or nickel alloyed compositions. Terminal pads are applied by typical metallizing techniques employing a solder composition.

The coil spring wiper is designed so that there is a maximum number of turns in the lineal dimension of the wiper to provide optimum contact with the resistance element. The size of the wire is chosen for resiliency and strength as well as to get the maximum number of turns per lineal dimension. Thus, if the wire is too large in diameter, an insufficient number of turns are produced; if it is too small, the coil spring wiper will collapse or bend under the continued pressure. The coil spring is constructed of any metal that has good electrical conductivity, is non-corrosive and is capable of being hardened into a spring-like consistency. A preferred form is paliney 6 which is a proprietary composition of the Ney Company. Additionally, nichrome, tungsten, and copper alloys may be used. The typical diameter of the wire is from 2 to 5 mils. The coil dimensions from a ⅜ inch size potentiometer are approximately .032 inches diameter and .080 inches long.

The resilient support for the coil spring wiper is preferably composed of silicone rubber having a predetermined hardness sufficient to compress on contact. The techniques and combinations described here may be used in a number of different sizes of potentiometers taking into account ordinary considerations of power dissipation and mechanical scaling of the units.

It should also be understood that the lead attachment method and configuration described with respect to FIG. 9 is applicable to many types of substrate elements such as resistor network packages and dual-in-line packages. The essence of this lead attachment technique is that good mechanical connections are made between conductor and substrate and unsoldering of leads is prevented when the package is soldered into a circuit board. This is an important improvement which is not employed in the types of networks and packages described.

While the invention has been described and illustrated with respect to preferred embodiments which provide satisfactory results, it should be understood by those skilled in the art that various changes and modifications may be made therein without departing from the true spirit and scope of the present invention.

What is claimed is:

1. A single-turn variable resistance device comprising:

a substrate, having an opening therein, said substrate including a central collector ring and an arcuate resistance element;

terminal means on said substrate for connection to at least one end of the resistance element and the central collector ring;

a rotor having an integral split shaft extending therefrom, said shaft extending through said opening and journalled to rotate in said opening of said substrate;

means for separating the ends of the split shaft extending through the opening for enlarging the shaft and to rotatably secure said rotor to said substrate;

conductor leads affixed to said terminal means, at least the central conductor lead having a portion protruding above the surface of the substrate;

said rotor including a protrusion which will interfere with the portion of the conductor lead protruding above the surface of the substrate to act as a stop to prevent the rotor from exceeding 360° of travel;

each of the terminal means including a hole therethrough, the ends of each of the conductors being wrapped around the portion of the substrate extending from each hole to the end of the substrate;

said substrate also including a semi-hole at the end of the substrate below each terminal means hole to enable axial alignment of the main conductor portion;

said rotor including a recess in said rotor facing said resistance element; and a resilient support inserted in said recess and a helical coil spring wiper also inserted in said recess and pressed against said resistance element and collector ring by the resilience of the support element and stored compressive force of the spring.

2. The device of claim 1, wherein said recess is disposed radially with respect to the center of rotation of said rotor and spaced apart therefrom.

* * * * *

UNITED STATES PATENT AND TRADEMARK OFFICE

CERTIFICATE OF CORRECTION

PATENT NO. : 3,964,011

DATED : June 15, 1976

INVENTOR(S) : RANDALL C. RAGAN

It is certified that error appears in the above-identified patent and that said Letters Patent are hereby corrected as shown below:

Column 2, line 40, "s" should be --"s"--

Column 4, line 26, "fixed" should be --fired--
line 37, "connecting" should be --connection--

Column 6, line 53, "constructed" should be --construction--

Column 8, line 1, "techniques" should be --technique--
line 53, "top hat" should be --"top hat"--

Signed and Sealed this

Fourteenth Day of September 1976

[SEAL]

*Attest:*

RUTH C. MASON
*Attesting Officer*

C. MARSHALL DANN
*Commissioner of Patents and Trademarks*